US009538835B2

(12) United States Patent
Grewal

(10) Patent No.: US 9,538,835 B2
(45) Date of Patent: Jan. 10, 2017

(54) BRISTLE EXTRUDING TOOTHBRUSH

(71) Applicant: Herman Grewal, Ingersoll (CA)

(72) Inventor: Herman Grewal, Ingersoll (CA)

( * ) Notice: Subject to any disclaimer, the term of this patent is extended or adjusted under 35 U.S.C. 154(b) by 0 days.

(21) Appl. No.: 14/918,752

(22) Filed: Oct. 21, 2015

(65) Prior Publication Data

US 2016/0120298 A1 May 5, 2016

Related U.S. Application Data

(60) Provisional application No. 62/069,894, filed on Oct. 29, 2014.

(51) Int. Cl.
*A46B 3/04* (2006.01)
*A46B 11/00* (2006.01)

(52) U.S. Cl.
CPC ..... *A46B 3/04* (2013.01); *A46B 11/0031* (2013.01); *A46B 2200/1066* (2013.01)

(58) Field of Classification Search
CPC ..... A46B 3/04; A46B 7/04; A46B 11/031; A46B 15/003; A46B 2200/1066
See application file for complete search history.

(56) References Cited

U.S. PATENT DOCUMENTS 3,026,146 A * 3/1962 Szabo ..... A46B 3/04 249/96
5,827,001 A * 10/1998 Taghavi-Khanghah ..... A46B 11/0041 401/145
2004/0022576 A1* 2/2004 Hoyle ..... A46B 11/0024 401/172
2004/0185762 A1* 9/2004 Turch ..... A46B 3/04 451/490
2007/0174984 A1* 8/2007 Diamond ..... A45D 20/525 15/106
2008/0213719 A1* 9/2008 Giniger ..... A46B 15/0002 433/32
2012/0272469 A1* 11/2012 Kwon ..... A46B 3/04 15/167.1
2013/0291320 A1* 11/2013 Kirchhofer ..... A46B 1/00 15/22.1

* cited by examiner

*Primary Examiner* — Jennifer C Chiang
*Assistant Examiner* — Bradley Oliver

(57) ABSTRACT

The present concept is a bristle extruding toothbrush and the method of the bristle extruding toothbrush replacing its own bristles. Polymer is stored in a reservoir in the body of the toothbrush before being heated and urged into an extrusion cavity by a screw housed in the reservoir. Molten polymer is extruded through bristle apertures on the extrusion face found on the brush head to form bristles by the action of an extrusion mold plunger.

16 Claims, 5 Drawing Sheets

156
156

102
106

152
108
162
114
160

104
112

BRISTLE EXTRUDING TOOTHBRUSH

This application claims priority from the previously filed provisional application No. 62/069,894, filed on Oct. 29, 2014 by Kevin Mako and Herman Grewal under the title: EXTRUDER BRUSH.

FIELD OF THE INVENTION

The present concept relates to toothbrushes and more particularly relates to a toothbrush which has the ability to renew its bristles by extruding bristles through the head of the toothbrush.

BACKGROUND OF THE INVENTION

Toothbrushes that are currently on the market include disposable toothbrushes which are discarded once the bristles on the head of the toothbrush have worn past the point of usability. There are also other toothbrushes on the market which allow one to replace the head of the toothbrush which disconnects from the handle of the brush roughly at the neck of the brush. In this manner the top portion including the bristles on the head can be removed and discarded and the handle is kept.

There are yet further brushes which are electrically activated namely they provide brushing action through a series of motors which provide a reciprocating and/or a rotating action of the head thereby aiding in the brushing action of the toothbrush.

There are yet other toothbrushes which include some toothpaste within the body of the handle which can be selectively discharged as required thereby effectively combining a toothbrush and the toothpaste tube into one unit.

With all of these toothbrushes there is still is the issue of ecological waste which ends up in landfill sites. Whether it is the traditional brush which is discarded when worn out or whether it is the brush with replaceable heads, there is still significant amount of waste that goes into landfill sites with the replacement components of these devices.

Therefore there is a need for a toothbrush which can regenerate its bristles without the need for disposable replacement parts.

SUMMARY OF THE INVENTION

The present concept is a bristle extruding toothbrush comprising:

a) a heated body with a reservoir for receiving polymer therein;

b) a screw housed within the reservoir for urging polymer into an extrusion cavity in a brush head connected to the body;

c) the brush head includes an extrusion face with bristle apertures;

d) a means for extruding polymer out of the extrusion cavity and through the bristle apertures thereby forming a bristle extrusion which includes bristles.

Preferably wherein the screw couples to an external dock for reciprocating and rotating the screw within the reservoir while coupled to the dock.

Preferably wherein the dock includes a motor drive coupled to the screw.

Preferably wherein the toothbrush further including heating elements in the body for heating the polymer to an extrusion temperature.

Preferably wherein the toothbrush further including heating elements in the screw for heating the polymer to an extrusion temperature.

Preferably wherein the extruding means includes an extrusion mold which releasably connects to the brush head, the extrusion mold includes a plunger which is slide-ably fit within the extrusion cavity and urges polymer out of the extrusion cavity and through the bristle apertures thereby forming the bristle extrusion.

Preferably wherein the extrusion mold includes an advancement mechanism for urging the plunger into the extrusion cavity.

Preferably wherein the brush head further includes a removable back on one side, and the extrusion face on the other side.

Preferably wherein the bristle extrusion is removable by detaching the removable back and the extrusion face from the brush head and the bristle extrusion.

Preferably wherein the polymer is preferably selected from the nylon family of polymers.

Preferably wherein the polymer preferably heated to between 190 and 230 degrees Celsius.

Preferably wherein the polymer preferably heated to between 200 and 220 degrees Celsius.

Preferably including a removable bottom cap for adding polymer to the reservoir.

The present concept is a method of extruding bristles from the brush head of a toothbrush comprising the steps:

a) fill a reservoir in the toothbrush body with polymer;

b) connect a bottom end of the body to a dock with a brush head downward, and place the brush head into an extrusion mold;

c) push an extrude button to activate an extrusion process;

d) a screw and neck heater warms the polymer to a molten extrusion temperature;

e) a motor drive in the dock reciprocates and turns the screw urging the polymer along a neck channel and into an extrusion cavity;

f) advancing an extrusion mold plunger to urge the molten polymer through bristle apertures thereby forming new bristles.

Preferably wherein step a is replaced with step a' as follows:

a') removing the bottom cap from the body to fill a reservoir in the toothbrush body with polymer and reinstalling the bottom cap.

BRIEF DESCRIPTION OF THE DRAWINGS

The present concept will be described by way of example only with reference to the following drawings in which.

DETAILED DESCRIPTION OF THE PREFERRED EMBODIMENTS

Figure 1:
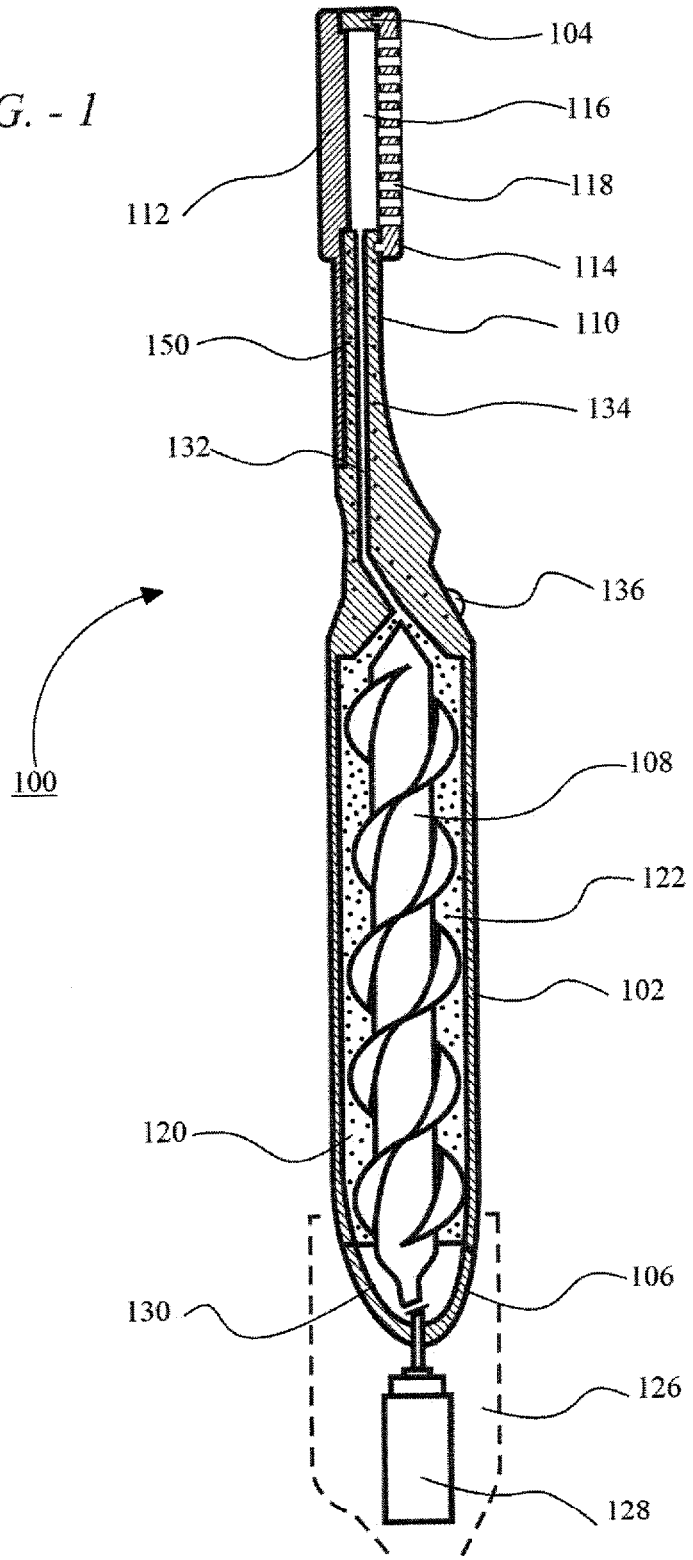
FIG. 1 is a schematic cross sectional side view of the present concept a toothbrush which has the ability to extrude bristles.

Referring first of all to FIGS. 1 through 7 the present concept is toothbrush 100 which includes the following major components namely body 102, brush head 104, bottom cap 106, screw 108 and neck 110.

Brush head 104 includes a removable back 112, an extrusion face 114, an extrusion cavity 116 and bristle apertures 118.

The lower portion of the body 102 of toothbrush 100 defines a reservoir 120 which will house polymer 122 therein.

In FIG. 1 toothbrush 100 is shown connected to dock 126 which contains a motor drive 128 and connects to the bottom end 130 of body 102 as schematically depicted in FIG. 1.

Dock 126 makes a mechanical connection between the motor drive 128 and the screw 108 thereby both reciprocating and rotating screw 108 when motor drive 128 is activated.

FIG. 1 further depicts channel 132 through which the polymer 122 flows as well as heating elements 134 which surround channel 132 to ensure that the polymer 122 remains molten as it flows through channel 132. FIG. 1 also depicts an extrude button 136 which is depressed in order to initiate the extruding action of toothbrush 100.

Figure 2:
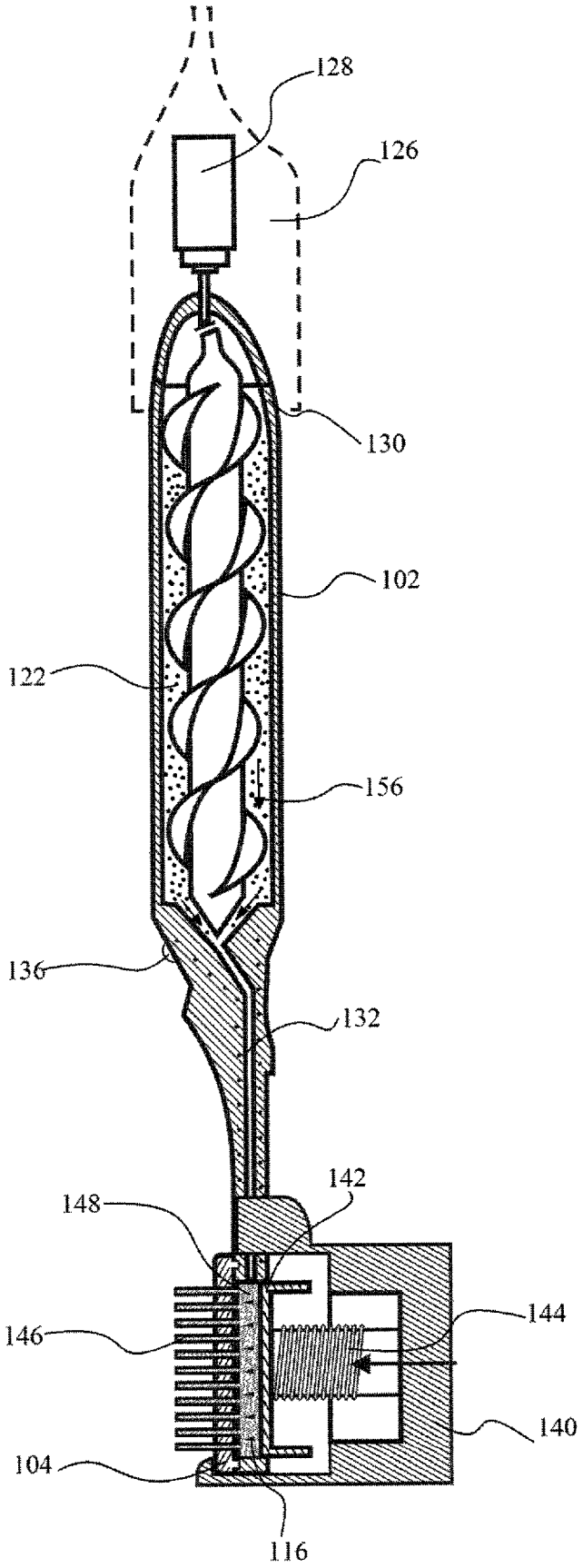
FIG. 2 is a schematic cross sectional view of the toothbrush shown in FIG. 1 in the inverted position shown connected to a dock at the top portion and an extrusion mold at the bottom portion.

Now referring to FIG. 2 which shows toothbrush 100 in the inverted position wherein the bottom end 130 is releasably attached to dock 126 and the brush head 104 is also releaseably engaged within extrusion mold 140. In the inverted position shown in FIG. 2 toothbrush 100 is in a position in which extrusion of new bristles can take place.

By depressing extrude button 136 the motor drive 128 as well as connections to the internal heaters is activated thereby heating polymer 122 located within reservoir 120 of body 102. The action of screw 108 forces molten polymer 148 down the length of the body 102 of toothbrush 100 and through channels 132 and into extrusion cavity 116.

Once molten polymer 148 is located in extrusion cavity 116 a plunger 142 forceably urges molten polymer 148 out through bristle apertures 118 thereby forming bristles 146. An advancement screw 144 or other advancement mechanism within extrusion mold 140 is used to urge plunger 142 into extrusion cavity 116.

Extrusion mold 140 is releaseably attached to the neck 110 as well as the brush head 104.

Neck heaters 150 as well as screw heaters 152 maintain polymer 122 in its molten state namely molten polymer 148.

FIG. 2 depicts the flow of molten polymer as 156 shown as polymer flow flowing downwardly along body 102 through channels 132 and into extrusion cavity 116.

Figure 3:
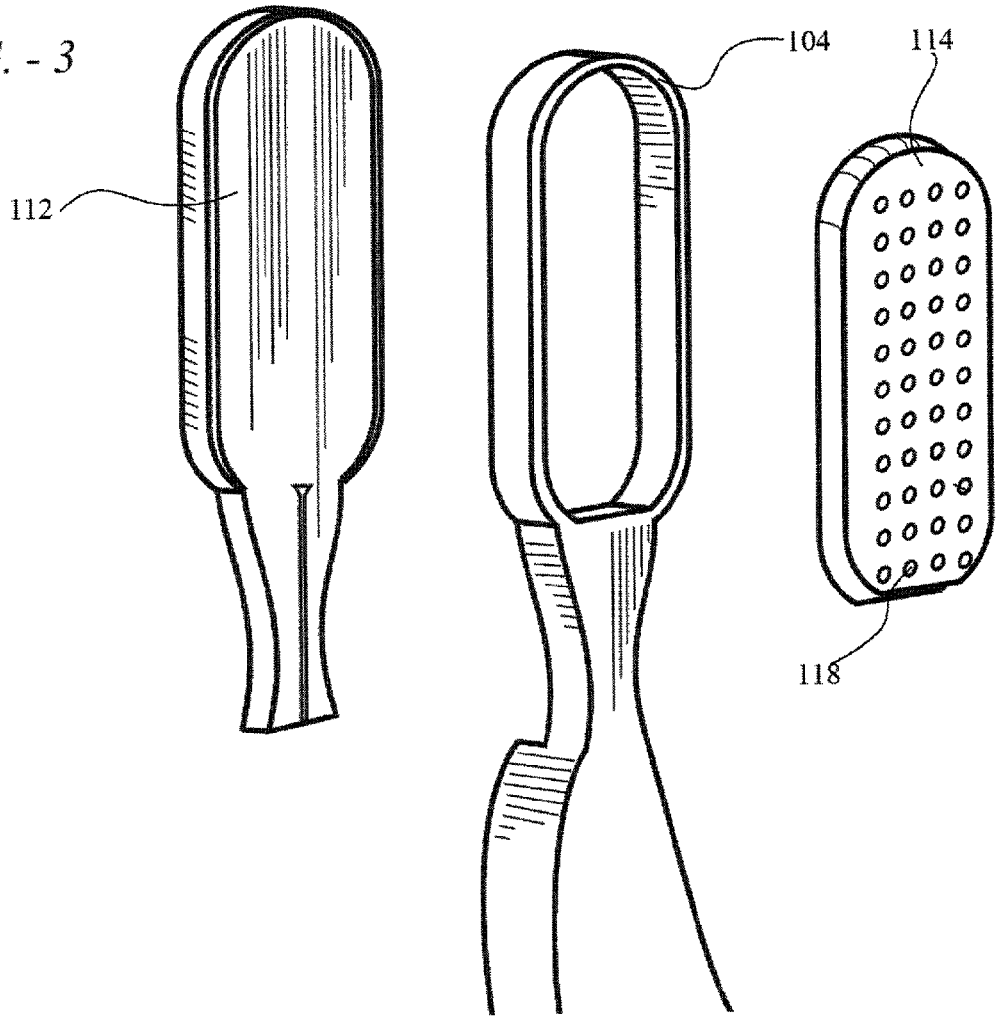
FIG. 3 is a schematic perspective assembly view of the top portion of the brush showing the brush head, the extrusion face and the removable back.

Referring now to FIGS. 3 which is an assembly of the removable back 112, the brush head 104 and the extrusion face 114.

Both the removable back and the extrusion face are clipped into position onto brush head 104 and can be removed for cleaning purposes and also for the purpose of removing a bristle extrusion 160.

Figures 4, 5, 6, 7:
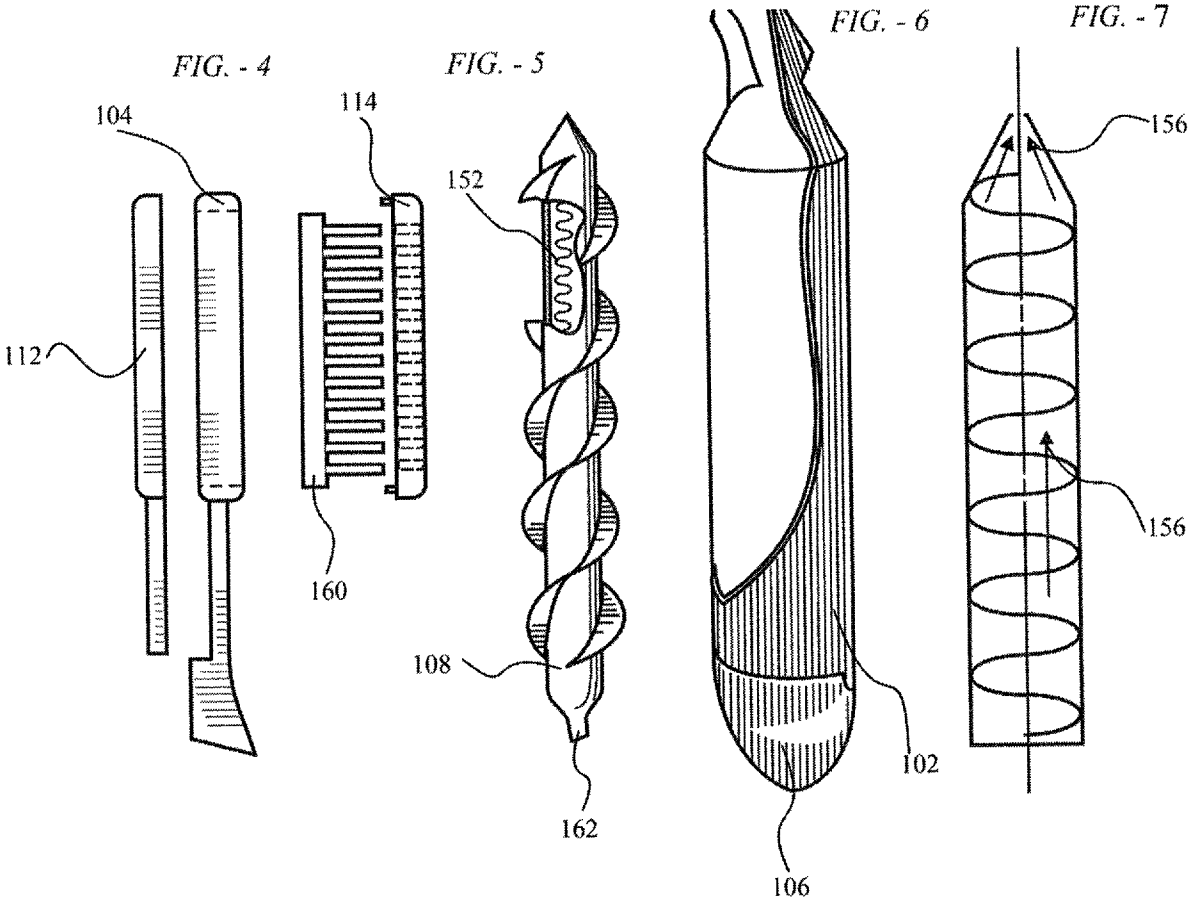
FIG. 4 is a schematic side assembly view of the brush head together with the removable back, the extrusion face and a bristle extrusion.
FIG. 5 is a schematic perspective partial cut away view of the screw showing screw heaters embedded within the screw.
FIG. 6 is a partial schematic perspective view of the body showing the removable bottom cap.
FIG. 7 is a schematic diagram showing the direction of flow of the polymer through the body.

Referring now to FIG. 4 which shows an exploded assembly view of removable back 112, brush head 104, extrusion face 114 as well as a bristle extrusion 160.

Once bristles 146 have worn to the point where there are no longer usable it is necessary to remove removable back in order to extract the spent bristle extrusion from brush head 104. In cases where cleaning is necessary it is also possible to remove extrusion face 114 thereby being able to completely clean brush head 104, removable back 112 and extrusion face 114 separately.

FIG. 5 depicts screw 108 and in cut away fashion shows screw heater 152 running through roughly the centre of screw 108 for heating of screw 108 and ultimately the polymer 122 surrounding screw 108. There is a coupling 162 at the bottom end of screw 108 which couples with motor drive 128.

FIG. 6 depicts body 102 and removable bottom cap 106.

FIG. 7 depicts schematically the direction of flow 156 of molten polymer 148 through the body and out through to the neck.

Figure 8:
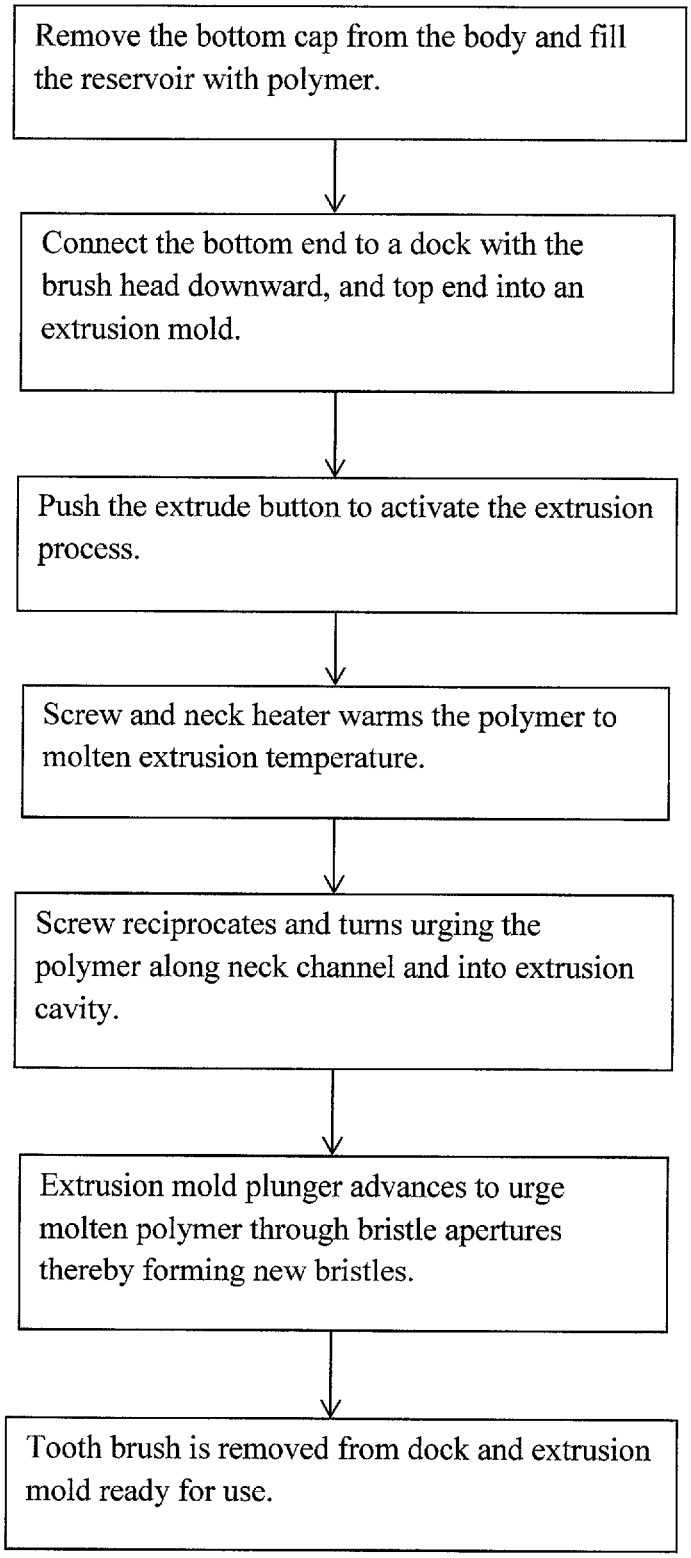
FIG. 8 is a table showing the method of extruding bristles from the head of a toothbrush comprising the steps as shown in FIG. 8.

A method of extruding bristles from the head of toothbrush 100 is summarized in FIG. 8 as follows:

Step 1 requires removing the bottom cap from the body and filling the reservoir with polymer. The polymer can be in the form of pellets, powder or granules or may even be in the form of a liquid.

The next step is to connect the bottom end 130 to a dock 126 with the brush head 104 downward and the top end inserted into an extrusion mold 140.

The next step is to push the extrude button 136 to activate the extrusion process.

The next step is the activation of screw 108 and the heating elements 134 including the neck heater 150 and the screw heater 152 thereby warming the polymer 122. This forms a molten polymer 148 which has the ability to flow through channel 132 and into extrusion cavity 116.

The screw 108 is coupled to motor drive 128 which reciprocates and turns thereby urging the polymer along the neck channel 132 and into the extrusion cavity 116.

In the next step with the extrusion mold removeably snapped into place onto the brush head and neck 110 portion of brush 100, the plunger 142 advances to urge molten polymer 148 through the bristle apertures 118 of extrusion face 114 thereby forming new bristles 146.

In the last step the toothbrush is removed from the dock and the extrusion mold is ready for use.

It should be apparent to persons skilled in the arts that various modifications and adaptation of this structure described above are possible without departure from the spirit of the invention the scope of which defined in the appended claim.

I claim:

1. A bristle extruding toothbrush comprises;

a) a heated body with a reservoir for receiving polymer therein;

b) a screw housed within the reservoir for urging polymer into an extrusion cavity in a brush head connected to the body;

c) the brush head includes an extrusion face with bristle apertures;

d) a means for extruding polymer out of the extrusion cavity and through the bristle apertures thereby forming a bristle extrusion which includes bristles.

2. The bristle extruding toothbrush claimed in claim 1 wherein the screw couples to an external dock for reciprocating and rotating the screw within the reservoir while coupled to the dock.

3. The bristle extruding toothbrush claimed in claim 2 wherein the dock includes a motor drive coupled to the screw.

4. The bristle extruding toothbrush claimed in claim 1 wherein the toothbrush further including heating elements in the body for heating the polymer to an extrusion temperature.

5. The bristle extruding toothbrush claimed in claim 1 wherein the toothbrush further including heating elements in the screw for heating the polymer to an extrusion temperature.

6. The bristle extruding toothbrush claimed in claim 1 wherein the extruding means includes an extrusion mold which releasably connects to the brush head, the extrusion mold includes a plunger which is slide-ably fit within the extrusion cavity and urges polymer out of the extrusion cavity and through the bristle apertures thereby forming the bristle extrusion.

7. The bristle extruding toothbrush claimed in claim 1 wherein the extrusion mold includes an advancement mechanism for urging the plunger into the extrusion cavity.

8. The bristle extruding toothbrush claimed in claim 1 wherein the brush head further includes a removable back on one side, and the extrusion face on the other side.

9. The bristle extruding toothbrush claimed in claim 8 wherein the bristle extrusion is removable by detaching the removable back and the extrusion face from the brush head and the bristle extrusion.

10. The bristle extruding toothbrush claimed in claim 1 wherein the polymer is preferably selected from the nylon family of polymers.

11. The bristle extruding toothbrush claimed in claim 1 wherein the polymer preferably heated to between 190 and 230 degrees Celsius.

12. The bristle extruding toothbrush claimed in claim 1 wherein the polymer preferably heated to between 200 and 220 degrees Celsius.

13. The bristle extruding toothbrush claimed in claim 1 further including a removable bottom cap for adding polymer to the reservoir.

14. A method of extruding bristles from the brush head of a toothbrush comprising the steps:

a) fill a reservoir in the toothbrush body with polymer;

b) connect a bottom end of the body to a dock with a brush head downward, and place the brush head into an extrusion mold;

c) push an extrude button to activate an extrusion process;

d) a screw and neck heater warms the polymer to a molten extrusion temperature;

e) a motor drive in the dock reciprocates and turns the screw urging the polymer along a neck channel and into an extrusion cavity;

f) advancing an extrusion mold plunger to urge the molten polymer through bristle apertures thereby forming new bristles.

15. The method claimed in claim 14 wherein step a is replaced with step a' as follows:

a') removing the bottom cap from the body to fill a reservoir in the toothbrush body with polymer and reinstalling the bottom cap.

16. The method claimed in claim 14 further including the step of removing the tooth brush from the dock and the extrusion mold.

* * * * *